United States Patent [19]

Turner et al.

[11] Patent Number: 4,938,603

[45] Date of Patent: Jul. 3, 1990

[54] FOLDABLE HIGH CHAIR

[75] Inventors: Dennis M. Turner, North Columbus; Robert A. Schwartzkopf; Donald L. Gerken, both of Columbus, all of Ind.

[73] Assignee: Cosco, Inc., Columbus, Ind.

[21] Appl. No.: 310,069

[22] Filed: Feb. 10, 1989

[51] Int. Cl.[5] ..... A47C 4/00

[52] U.S. Cl. ..... 297/16; 297/35; 297/379; 297/153

[58] Field of Search ..... 297/16, 35, 29, 19, 297/149, 151, 40, 39, 47, 359, 379, 356, 148, 379

[56] References Cited

U.S. PATENT DOCUMENTS

| | | | |
|---|---|---|---|
| 2,505,490 | 4/1950 | Greenbaum | 297/151 |
| 3,425,744 | 2/1969 | Spector et al. | 297/19 |
| 3,715,142 | 2/1973 | Lay et al. | 297/39 |
| 4,603,902 | 8/1986 | Maloney | 297/35 |
| 4,614,377 | 9/1986 | Luo | 297/35 X |
| 4,768,825 | 9/1988 | Quinlan, Jr. | 257/35 X |
| 4,807,928 | 2/1989 | Cone | 257/151 X |

FOREIGN PATENT DOCUMENTS

| | | | |
|---|---|---|---|
| 2453732 | 5/1976 | Fed. Rep. of Germany | 297/379 |

*Primary Examiner*—Peter A. Aschenbrenner
*Attorney, Agent, or Firm*—Barnes & Thornburg

[57] ABSTRACT

A lock-release mechanism is mounted on the back of a foldable high chair to control relative movement between the chair back and the underlying seat and leg assembly. In use, the bolt-release mechanism can be actuated manually to permit the high chair to be folded from an unfolded use position to a partly folded safety stop position and a fully folded storage position.

35 Claims, 3 Drawing Sheets

FOLDABLE HIGH CHAIR

This invention relates to foldable high chairs for children and, in particular, to a manually releasable lock mechanism for locking the foldable high chair in its unfolded use position. More particularly, this invention relates to a high chair lock-release mechanism that can be manually actuated by an operator easily using only a single hand.

Parents and child supervisors will attest to the difficulties that can arise in operating conventional lock-release mechanisms on foldable high chairs to ready the chair for collapse from an unfolded use position to a fully folded storage position. At times, parents find that only one hand is free and available to operate such mechanisms and that one-handed operation is difficult or impossible. Further, many known high chair lock-release mechanisms are mounted in hard-to-reach locations on the high chair and include at least two widely spaced-apart actuator knobs or the like.

Nevertheless, parents do appreciate the value of a secure high chair lock mechanism which guards against inadvertent folding of a foldable high chair while a child is seated therein and is not easily operated by a child seated on the high chair or other toddler or youngster near the chair. Examples of various high chair locking mechanisms are shown in U.S. Pat. Nos. 4,603,902; 4,653,805; and 4,696,514.

One object of the present invention is to provide a lock-release mechanism that can be grasped and manipulated easily by an adult using only one hand to unlock a foldable high chair so that the chair can be folded for storage.

Another object of the present invention is to provide a two-stage, high chair, lock-release mechanism that is configured to provide a first stage release position wherein the high chair is movable only to a partly folded, safety stop position and a second stage release position wherein the high chair is subsequently movable from its safety stop position toward its fully folded storage position.

Yet another object of the present invention is to provide a manually actuated lock-release mechanism that is mountable on the back of a high chair to control relative movement between the chair back and an underlying collapsible frame assembly so that the high chair can be folded easily to an intermediate partly folded safety position and fully folded storage position.

Still another object of the present invention is to provide a lock-release mechanism that is safely and protectedly mounted inside a hollow cavity formed in the back of a foldable high chair and configured normally to lock the high chair in its unfolded use position until the lock-release mechanism is manually actuated by an adult.

According to the present invention, a foldable high chair for juveniles includes a seat, a back, and a collapsible frame assembly movable between an unfolded use position and a folded storage position, means is provided for attaching each of the seat and back to the collapsible frame assembly for movement relative to the collapsible frame assembly during movement of said assembly between its use and storage positions. Movement of the collapsible frame assembly to its unfolded use position causes the seat and back to be aligned relative to one another in a chair-forming position to support an occupant seated therebetween.

The chair further includes means for locking the back and collapsible frame assembly together to block movement of the collapsible frame assembly from its unfolded use position toward its folded storage position. Thus, the locking means can be actuated to fix the seat and back relative to one another in the chair-forming position. Releasing means is also provided for releasing the locking means to permit movement of the collapsible frame assembly from its unfolded use position to its folded storage position. The releasing means is connected to the locking means and the back and also supported for movement relative to the back.

In preferred embodiments, the releasing means includes a release handle formed to include a recessed finger grip portion receiving the fingers of a user hand operating the release means. The back includes means for supporting the palm of the hand operating the release means to position said fingers in engagement with the recessed finger grip portion.

The releasing means further includes guiding means connected to the back for guiding the release handle for movement relative to the supporting means between locking and unlocking positions. In its locking position, the release handle activates the locking means to lock the collapsible frame assembly in its unfolded use position. In its unlocking position, the release handle releases the locking means to unlock the collapsible frame assembly so that it is movable to its folded storage position. The releasing means further includes spring means interconnecting the back and the release handle for yieldably biasing the release handle to its locking position so that the collapsible frame assembly is normally locked to the back when in its unfolded use position.

In use, the release handle is moved by the spring means relative to the back in a direction away from the supporting means to reach its locking position. The release handle is movable against the force of the spring means by an adult in an opposite direction toward the supporting means a first distance to reach a safety stop position and then an additional second distance to reach its unlocking position. In particular, the release handle is moved toward its unlocking position upon movement of the recessed finger grip portion toward the supporting means in response to inward curling movement of the user's hand to make a fist while the palm of the hand is resting on the supporting means of the back and the fingers of the hand are inserted into the recessed finger grip portion of the release handle.

Of course, the user must apply enough force to the release handle to overcome the force of the biasing spring and move the release handle first to its safety stop position and then to its unlocking position. Advantageously, the user can press the palm of the hand being used to operate the release handle against the supporting means to generate the "squeezing force" needed to overcome the opposing biasing force of the spring means. Such a high chair lock-release mechanism is easily actuated using a single free hand to release the high chair from its locked position so that it can be then folded for storage or transport to another location.

Additional objects, features, and advantages of the invention will become apparent to those skilled in the art upon consideration of the following detailed description of the preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

A foldable high chair is provided with a squeeze-actuated lock-release mechanism which includes a lock assembly interconnecting the backrest assembly and the chair frame. The assembly is configured normally to lock the high chair in either an unfolded upright, child-seating position or a partly folded "safety stop" position.

A lock-release mechanism in accordance with the present invention can be actuated easily by an adult using only one hand to unlock a high chair locked in its upright position so that it can be folded for storage or travel. The configuration of the lock-release mechanism to provide a safety stop position intermediate the unfolded use position and the folded storage position creates a feature which acts to guard against inadvertent folding of the chair to its fully folded storage position. Advantageously, it is not necessary to remove a feeding tray attached to the high chair prior to actuating the lock-release mechanism or folding the high chair. In addition, those skilled in the art will appreciate that the innovative lock-release mechanism is well-suited for use with a conventional "forward-folding" high chair in which the backrest assembly member pivots toward the seat during folding of the chair even though the mechanism is described generally in connection with a "reverse-folding" high chair of the type illustrated in FIG. 1.

Figure 1:
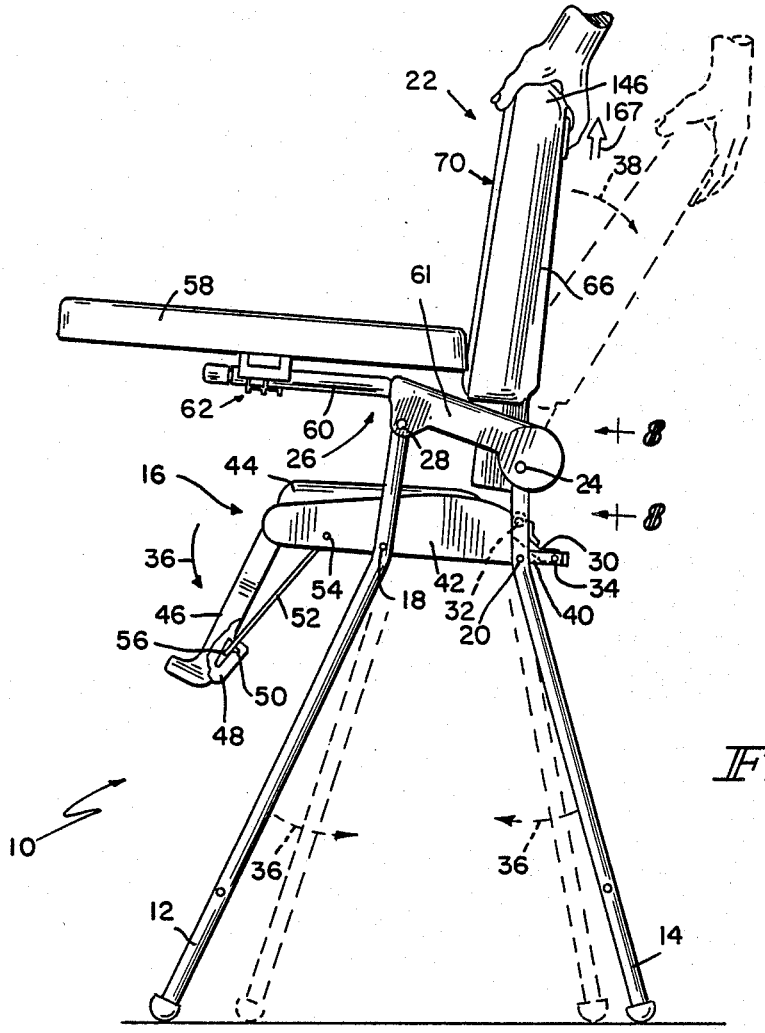
FIG. 1 is a side elevational view of a chair embodying the present invention in its unfolded use position, with the chair shown in a partially folded, "safety stop" position in phantom.

Referring to FIG. 1, a high chair 10 is shown to include front legs 12, rear legs 14, a seat assembly 16 pivotally connected to each front leg 12 at first pivot 18 and each rear leg 14 at a second pivot 20, and a backrest assembly 22 pivotally connected to each rear leg 14 at a third pivot 24. An armrest assembly 26 is provided for each pair of front and rear legs 12, 14. Each armrest assembly is pivotally connected to a front leg 12 at fourth pivot 28 and a rear leg 14 at third pivot 24.

Plastic nonskid feet are placed at the lower ends of legs 12, 14 to provide a secure gripping surface for legs 12, 14 and to prevent the ends of legs 12, 14 from scratching or otherwise marring the flooring upon which the chair 10 is placed. A front cross-bar member (not shown) interconnects the front legs 12 and a back cross-bar member (not shown) interconnects the rear legs 14 to stabilize the chair 10 in its unfolded use position. In another embodiment (not shown), front legs 12 are replaced by a unitary, tubular, U-shaped piece having a bottom tube resting on the ground and side tubes extending upwardly from each end of the bottom tube to form the front legs of the chair 10. Similarly, a unitary, tubular, U-shaped piece can be used instead of the pair of rear legs 14. In such case, no additional cross-bar member is needed.

A boomerang-shaped control link 30 is provided on each side of seat assembly 16 to control folding movement of the backrest assembly 22 relative to the seat assembly 16. Each control link 30 is pivotally connected to backrest assembly 22 at fifth pivot 32 and to seat assembly 16 at sixth pivot 34 as shown best in FIGS. 1 and 3. It will be understood that high chair 10 is an example of an open spread-leg, reverse-folding high chair because of the arrangement of pivot connections between seat assembly 16, backrest assembly 22, and collapsible frame assembly 12, 14, 26, and 30. Essentially, these assemblies and pivot connections cooperate to pivot seat assembly 16 in a forward direction 36 and to pivot backrest assembly 22 in an opposite rearward direction 38 away from seat assembly 16 causing the included angle between assemblies 16, 22 to increase from about 90° to about 340° during folding of high chair 10 from its upright, unfolded use position shown in FIG. 1 to its fully folded storage position (not shown). Reference is hereby made to U.S. Pat. No. 4,603,902 to Maloney for a more detailed disclosure of a reverse-folding high chair configuration suitable for use in connection with the present invention.

Seat assembly 16 includes a generally U-shaped, tubular frame member 40, a molded plastic cushion-support frame 42 attached to frame member 40, and a soft, padded, contoured seat cushion 44 with a rolled front edge attached to an upwardly facing wall of cushion-support frame 42. Frame member 40 is pivotably connected to each front leg 12 at first pivot 18 and each rear leg 14 at second pivot 20 to enable seat assembly 16 to pivot relative to backrest assembly 22 during folding and unfolding of high chair 10.

A molded plastic footrest 46 is mounted to the underside of seat assembly 16 as shown in FIG. 1 to provide a rest for the chair occupant's feet. Preferably, footrest 46 is positionable either in a first position (shown in FIG. 1) wherein the footrest 46 extends downwardly from seat assembly 16 and a second position (not shown) wherein the footrest 46 extends outwardly and forwardly of seat assembly 16. The footrest 46 is positionable in its first position to provide a comfortable footrest for older children and is positionable in its second position to provide a comfortable footrest for younger children.

A bracket 48 formed to include an L-shaped slot 50 is mounted on the distal end of each side of footrest 46 as shown in FIG. 1. A U-shaped control rod 52 includes a pair of spaced-apart ends pivotably connected to frame member 40 at pivots 54 on either side of seat assembly 16 and a cross bar 56 slidably engaged in L-shaped slot 50. Cross bar 56 extends across the front of chair 10 and is manually operable to fix footrest 46 in either of its two use positions.

A large feeding tray 58 is coupled to arm members 60 of armrest assemblies 26 by means of two tilt-away coupling mechanisms 62. Arm members 60 extend out of the front end of the generally U-shaped plastic arm cover 61 as shown best in FIG. 1.

The coupling mechanism 62 on a first arm member 60 can be easily operated by an adult using only one hand to release the tray from engagement with the first arm member 60. Then, the tray 50 can be pivoted relative to the second arm member 60 about the other coupling mechanism 62 which is still attached to the second arm member 60. Essentially, the operator releases the tray from engagement with the first arm member 60, swings the tray 58 from its feeding position overlying seat assembly 16 to one side of seat assembly 16, then tilts the tray 58 with respect to the second arm member 60 so that it can be swung downwardly to an inactive position (not shown) along side legs 12 and 14 on the side of high chair 10 comprising the second arm member 60.

Once the tray 58 is tilted away to its inactive position, a child seated in the chair 10 can be removed easily. Also, in such inactive position, chair 10 can be folded or unfolded without necessarily disconnecting tray 58 from the second arm member 30 at coupling mechanism 62. Accordingly, chair 10 is conveniently storable or carriable in its fully folded storage position with the tray still attached to arm member 30. Conveniently, a tilt-away coupling mechanism 62 is provided on each side of the underside of tray 58 to enable a user to swing tray 58 to an inactive position on either side of high chair 10.

Figure 3:
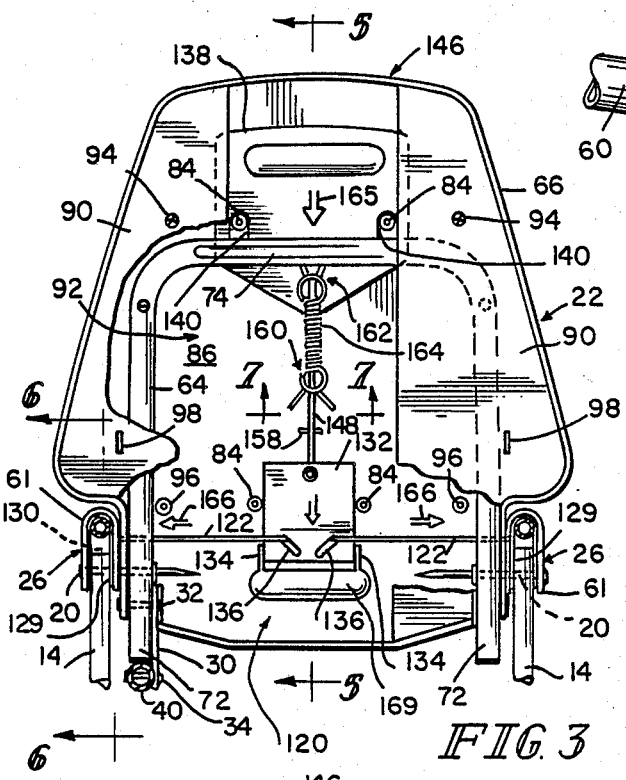
FIG. 3 is a front elevation view of the chair back assembly of FIG. 2, with portions broken away, showing latch rods in the lock-release mechanism outwardly extended to engage the armrest assembly of the chair to lock the chair in its upright, unfolded use position.
Figure 4:
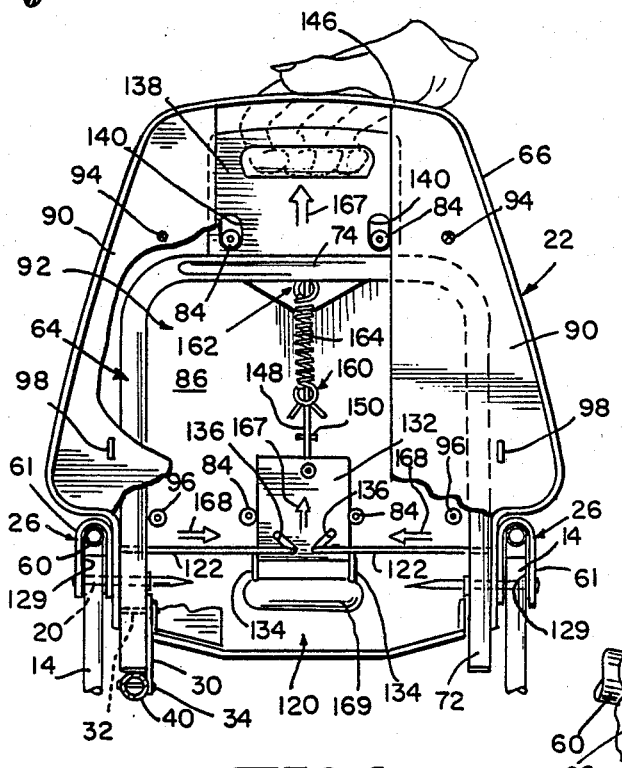
FIG. 4 is a view similar to FIG. 3 showing each latch rod in fully retracted position following hand-actuation of a release handle mounted in the chair back assembly so that the chair is unlocked and ready for folding to a fully folded position.

Backrest assembly 22 includes a U-shaped, tubular frame member 64, a molded plastic chair back shell 66 having a forwardly facing opening 68, and a seat back 70 positioned in the forwardly facing opening 68 of chair back shell 66 to support the back of a child seated on seat cushion 44. U-shaped frame member 64 includes a pair of side members 72 and a top member 74 extending therebetween as best shown in FIGS. 3 and 4. Each of the downwardly extending distal ends of side members 72 is pivotably connected to an upwardly extending end of one of the boomerang-shaped control links 30 at fifth pivot 32 as shown best in FIGS. 3 and 4 to connect the backrest assembly 22 for pivotable movement relative to the seat assembly 16 during folding and unfolding of high chair 10.

Figure 2:
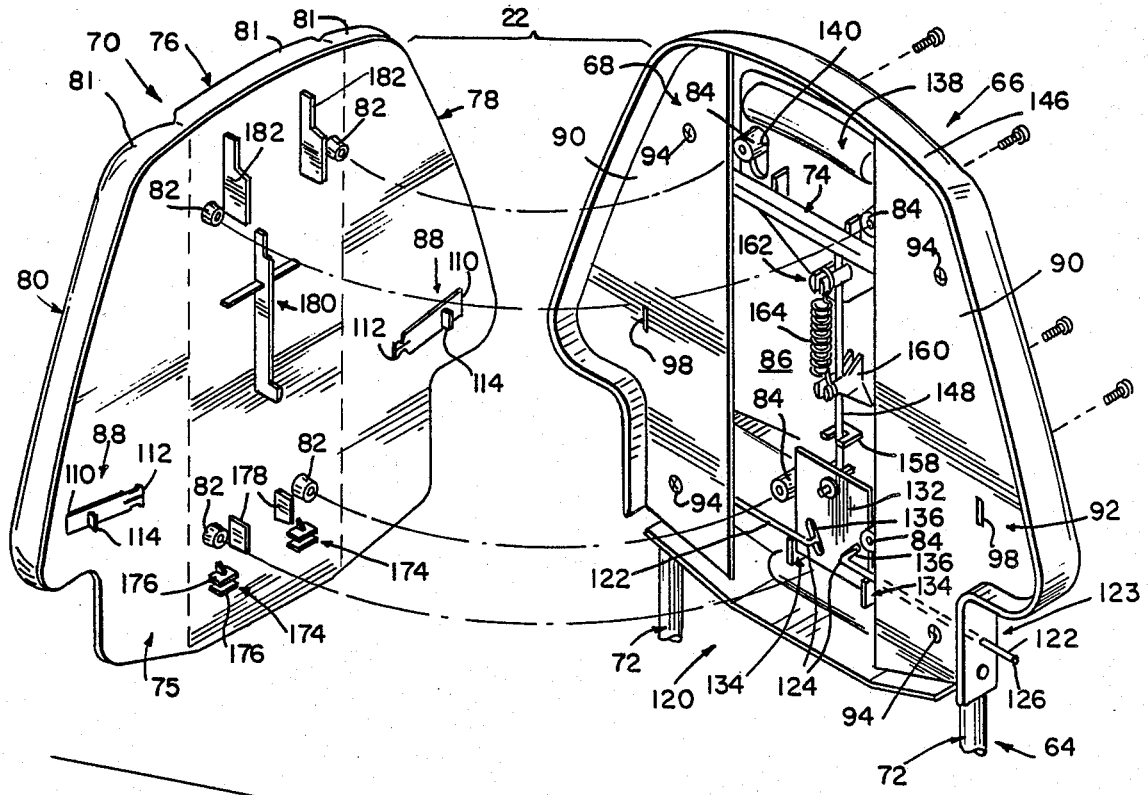
FIG. 2 is a perspective assembly view of the back of the chair of FIG. 1 showing a rear view of a back support cushion assembly including hinged side wings and a front view of a companion rigid chair back assembly containing a high chair lock-release mechanism.

Referring particularly to FIG. 2, seat back 70 includes a foldable mounting plate 75 articulated or otherwise hinged to provide a stationary central section 76 and two side wing sections 78, 80 which are movable relative to the stationary central section 76 to position a child seated on seat cushion 44. Laminated foam cushion material 81 is attached to the forwardly facing surface of each of central and side wing sections 76, 78, 80 to support the back of a child seated in high chair 10 comfortably. The portion of plate 75 defining central section 76 includes mounting posts 82 for engaging mounting posts 84 appended to a forwardly facing wall 86 of chair back shell 66 to fix central section 76 in a stationary position relative to chair back shell 66. Reference is hereby made to U.S. Pat. Nos. 4,696,514 and 4,603,902 to Maloney for a more detailed description of a suitable adjustable back assembly with movable side wings for use in connection with the present invention.

A wing retainer 88 is hingedly attached to a rearwardly facing surface of each side wing section 78, 80 as shown best in FIG. 2. Each wing retainer 88 is connectable to one of the cover plates 90 disposed in the interior region or cavity 92 of chair back shell 66. Each cover plate 90 is rigidly connected to chair back shell 66 by means of screws 94 engaged in mounting posts 96 appended to the forwardly facing wall 86 of chair back shell 66. Each cover plate 90 nests in the cavity 92 provided by chair back shell 62 and is formed to include a lug-receiving slot 98 as shown in FIGS. 2–4.

Each wing retainer 88 includes a proximal end 110 hingedly attached to one of side wing sections 78, 80 and a distal end configured to define a first lug 112 sized to engage in a lug-receiving slot 98 formed in cover plate 90 to position its side wing section 78 or 80 in a canted position (not shown) with respect to the stationary central section 76. Each wing retainer 88 further includes a second lug 114 projecting rearwardly from a middle portion of the retainer wing 88. This second lug 114 is configured to engage in its companion lug-receiving slot 98 and fix its side wing section 78 or 80 in a flat-back position relative to the stationary central section 76. The side wing sections 78, 80 are conveniently moved to their canted position to support a younger child in an upright position in high chair 10. Alternatively, the side wing sections 78, 80 can be moved to a flat-back position to accommodate a larger or older child in high chair 10.

A lock mechanism 120 is coupled to backrest assembly 22 to permit the backrest assembly 22 to be locked to the collapsible frame assembly 12, 14, 26 so that the backrest assembly 22 is locked in its upright, unfolded use position. Illustratively, the lock mechanism 120 includes a pair of latch rods 122 mounted in the interior cavity 92 of chair back shell 62 for reciprocable movement between an extended position shown in FIG. 3, and a partly retracted position shown in FIGS. 6 and 6A, and a retracted position shown in FIG. 4. The chair back shell 66 is formed to include a first cavity opening 123 on each side of chair 10 as shown best in FIG. 2 for permitting the latch rods 122 to project outwardly from the backrest assembly 22 to engage the rear legs 14.

Figure 8:
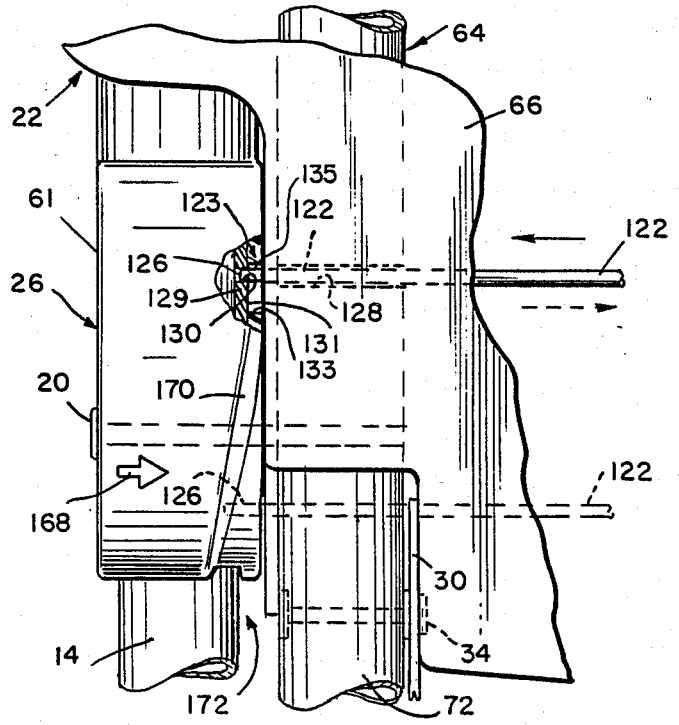
FIG. 8 is a transverse sectional view taken along lines 8—8 of FIG. 1, with portions broken away, showing the latch rod in its extended position engaging the armrest assembly of the chair, with the latch rod shown in position disengaging the armrest assembly in phantom.

Each latch rod 122 includes a hook member 124 at its inner end and a bolt member 126 at its outer end as shown best in FIG. 2. A latch-receiving aperture 128 is formed in each side member 72 of the U-shaped frame member 64 as seen in FIG. 8 in a location just above second pivot 20 to receive the reciprocable latch rod 122 therethrough so that the bolt member 126 extends to a position outside of interior cavity 92 when the latch rod 122 is in its extended position. In such extended position, the bolt member 126 of each latch rod 122 is inserted into a bolt-receiving aperture 130 formed in a rigid U-shaped bracket 129 mounted in a hollow region in the U-shaped arm cover 61 of each armrest assembly 26. Specifically, the bolt member 26 is placed in aperture 130 as shown in FIGS. 3 and 8 to block pivotable movement of the backrest assembly 22 relative to the seat assembly 16.

Figure 6:
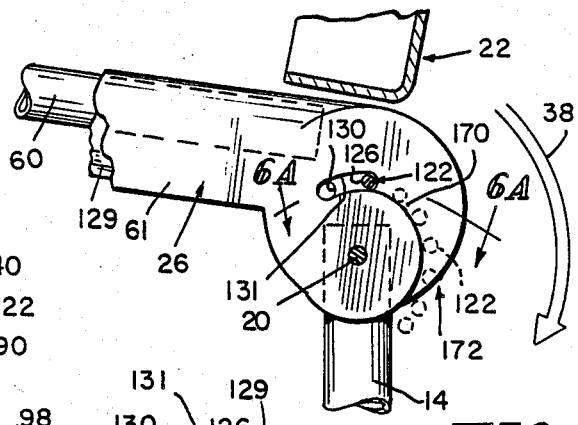
FIG. 6 is a longitudinal sectional view taken along lines 6—6 of FIG. 3 showing the relative position of the chair back assembly to a rear leg of the chair when the chair back assembly is pivoted in a rearward direction away from its locked unfolded use position to its "safety stop" position.
Figure 6A:
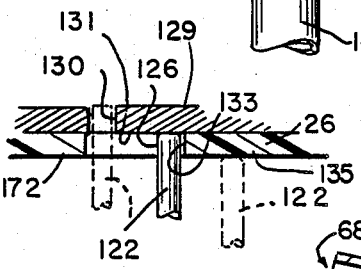
FIG. 6A is a sectional view taken along lines 6A—6A of FIG. 6 showing a safety slot in the armrest assembly and the bolt end of the latch rod in its safety stop position in the safety slot with the bolt end also shown in its extended and retracted positions in phantom.

In its partly extended position, the bolt member 126 of each latch rod 122 is inserted into safety channel 131 formed in a thick wall portion 135 of the armrest cover 61 as shown in FIGS. 6 and 8. The bolt member 126 is then moved to engage forwardly facing stop wall 133 in safety channel 131 as shown best in FIGS. 6 and 6A to stop the backrest assembly 22 in its safety stop position (shown in FIG. 1 in phantom). The rigid U-shaped bracket 129 is mounted on the inner surface of thick wall portion 135 so that the bolt-receiving aperture 130 is aligned with the safety channel 131.

A retractor plate 132 is mounted in interior cavity 92 for sliding movement to control the direction of movement of the reciprocable latch rods 122. Two spaced-apart mounting posts 84 and two spaced-apart guide walls 134 are appended to the forwardly facing wall 86 of chair back shell 66 to guide the sliding retractor plate 132 along a predetermined substantially vertical path as shown best in FIGS. 3 and 4. Retractor plate 132 is formed to include two diagonally extending slots 136 aligned in upwardly diverging, splayed relation. Each slot 136 is configured to receive the hook member 124 of one of the latch rods 122. It will be understood that each latch rod 122 will reciprocate along a guided horizontal path between its extended and retracted positions as retractor plate 132 slides along its guided vertical path because of the engagement of latch hook ends 124 in driving engagement with retractor plate 132 and the angled orientation of the latch hook-receiving slots 136.

A release handle 138 is mounted in an upper portion of cavity 92 as shown in FIGS. 2–5 for sliding movement between locking and unlocking positions. The release handle 138 is movable relative to the upper two mounting posts 84 fixed to chair back shell 66 and is formed to include a pair of spaced-apart parallel, vertically extending, lost-motion guide slots 140 for receiving the upper two mounting posts 84 therein. The length of each slot 140 is greater than the diameter of each fixed mounting post 84 so that the release handle 138 is able to move up and down relative to chair back shell 166 along a vertical path defined by the upper two mounting posts 84 in cooperation with the lost-motion guide slots 140 in release handle 138. Illustratively, release handle 138 is positioned between the top member 74 of the frame member 64 and the forwardly facing surface 86 of chair back shell 66 and is slidable between its lower locking position shown in FIGS. 3 and 5 and its upper unlocking position shown in FIG. 4.

Figure 5:
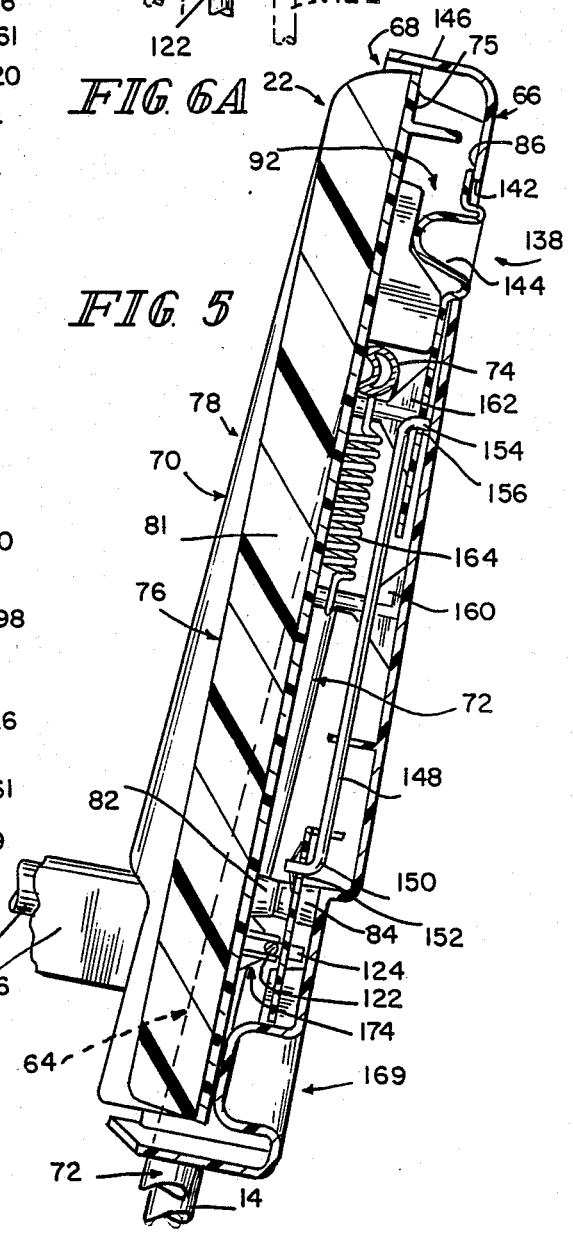
FIG. 5 is a longitudinal sectional view taken along lines 5—5 of FIG. 3 showing the lock-release mechanism housed in a hollow interior region of the chair back assembly.

Chair back shell 66 is formed to include a rearwardly facing, second cavity opening 142 as shown best in FIG. 5 to permit a user to gain access to a rearwardly facing, recessed finger grip portion 144 of the release handle 138 which is disposed in the interior cavity 92 of backrest assembly 22. The outer rim of finger grip portion 144 protrudes outwardly through the second cavity opening 142 in chair back shell 66 so that the curled fingers of a user are receivable therein to permit the user to slide the release handle 138 in the opening 142 between its locking and unlocking positions. Conveniently, as shown in FIGS. 1 and 4, the finger grip opening 142 is positioned near a top outer palm-support surface 146 of the chair back shell 66 so that the palm of the hand selected by the user to operate the release handle 138 is supported on the top outer surface 146 when the fingers are inserted into the finger grip portion 144 to provide leverage and assist the user in operating the release handle 138.

A connecting rod 148 is provided for coupling the retractor plate 132 to the release handle 138 for movement therewith. The connecting rod 148 has a lower hooked end 150 inserted into aperture 152 formed in retractor plate 132 and an upper hooked end 154 inserted into aperture 156 formed in a lower portion of the release handle 138 as seen in FIG. 5. First and second rod guide members 158, 160 are attached to the forwardly facing surface 86 of the chair back shell 66 and are formed to include vertically extending, forwardly facing, rod-receiving guide channels therein as shown best in FIGS. 2 and 7. A third rod guide member 162 is fixed to the lower portion of release handle 138 to receive connecting rod 148 in a similar guide channel formed therein.

A coiled spring 164 interconnects the distal ends of each of second and third rod guide members 160, 162. The second rod guide member 160 is fixed to chair back shell 66, and third rod guide member 162 is fixed to release handle 138 and is thus movable relative to the second rod guide member 160. Spring 164 acts to yieldably bias release handle 138 downwardly in direction 165 toward the seat assembly 16 to its locking position shown in FIGS. 3 and 5. In that locking position, the connecting rod 148 effectively pushes retractor plate 132 downwardly in direction 165 to its lower position wherein the latch rods 122 connected to retractor plate 132 are urged in opposite outward directions 166, causing the bolt members 126 at the outermost ends of latch rods 122 to engage the armrest assemblies 26, thereby blocking pivoting movement of the backrest assembly 22 to its folded position. This locking mechanism can be released manually by pulling the release handle 138 upwardly in direction 167 with enough force to overcome the biasing force generated by spring 164 to pull the retractor plate 132 upwardly in direction 167 by means of connecting rod 148. Such upward movement of the retractor plate 132 causes the diagonally extending slots 136 in the retractor plate 132 to draw latch rods 122 inwardly toward one another in directions 168 to withdraw the bolt members 126 from movement-blocking engagement with the armrest assemblies 26.

In operation, a user can release the lock mechanism to permit high chair 10 to be folded by gripping the release handle 138 on the back and applying a squeezing force across the release handle 138 and the palm-support portion 146 of the chair back shell 66. Essentially, the release handle 138 is "squeezed" by a user placing the palm of a free hand on palm-support surface 146 of chair back shell 66 and then curling the fingers of that hand inwardly toward the supported palm to move the release handle 138 upwardly toward its unlocking position using leverage provided by the action of the palm against the palm-supporting surface 146. The user can then continue squeezing and pulling the backrest assembly 22 toward the rear and downward in direction 38 until it rests against the back side of the rear legs 14. A step-by-step description of this lock-release process is set forth in the following paragraph.

To unlock the chair 10 from its upright use position, the release handle 138 is squeezed a first time to withdraw the bolt members 126 from bolt-receiving apertures 130 in armrest assemblies 26 and place them in safety channels 131. Movement of backrest assembly 22 in rearward direction 38 will normally cause bolt members 126 to engage stop walls 133 in armrest assemblies 26, thereby blocking any further rearward folding movement of the backrest assembly and effectively defining a "safety stop" position of the type shown in FIG. 1 in phantom. The release handle 138 can be squeezed again to withdraw both members 126 from safety channels 131 and place them on ramps 170 so that the backrest assembly 22 can then be pushed further in direction 38 from its safety stop position toward its fully folded storage position. To carry the folded high chair 10, a built-in handle 169 can be molded into a rearwardly facing portion of the cushion-support frame 42, as shown best in FIG. 5.

To unfold, it is necessary only to pull the backrest assembly up until it "snaps" first into its safety stop position and then its upright position. A contoured cam ramp 170 is formed on a rearwardly facing portion 172 of each armrest assembly 26 as shown in FIGS. 6 and 8 to cam the bolt members 126 on latch rods 122 inwardly in direction 168 against the biasing force of spring 164 to a position where the bolt members 126 are presented toward the open mouths of the bolt-receiving apertures 130. At this stage, the bolt members 126 will behave like spring-loaded detents and snap first into safety channels 131 and then into the apertures 130 to lock the backrest assembly 22 to the armrest assemblies 26, thereby retaining the chair 10 in its unfolded upright use position shown in FIG. 1. Apertures 130 could also be formed in the rear legs in another embodiment.

Figure 7:
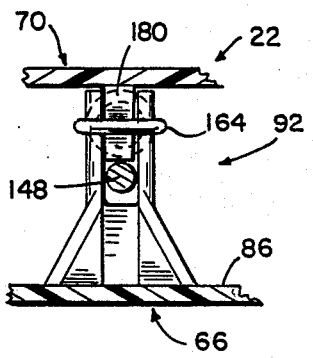
FIG. 7 is a transverse sectional view taken along lines 7—7 of FIG. 3 showing cooperation of guide members on the back support cushion assembly and the chair back assembly to guide a reciprocable connecting rod which links the release handle to a retractor plate that is configured to reciprocate the latch rod between its extended and retracted positions.

Referring to FIGS. 2 and 7, it will be seen that guide members can be mounted to the rearwardly facing surface of stationary central section 76 to cooperate with corresponding guides on the chair back shell 66 or other pieces to control and guide moving elements in the linkage comprising the lock-release mechanism 120. For example, guides 174 include a pair of walls 176 spaced apart to receive the reciprocable latch rod 122 therebetween. Each guide 178 provides a wall which helps to define the sliding path of the reciprocable retractor plate 132, elongated guide 180 acts to prevent spring 164 from detaching from its biasing position connected to rod guide members 158 and 160, and spaced-apart parallel guide walls 182 help to define the sliding path of the reciprocable release handle 132.

It will be understood that it is within the scope of the present invention to use various types of mechanical linkages to connect the release handle 138 and the latch rods 122 together so that the latch rods 122 move to lock and unlock the chair 10 under the control of release handle 138. For example, a cord and pulley system, a hinged linkage system using a main driving member coupled to the release handle and flexible fingers on the driving member coupled to the latch rods or the like could be used to convert the upward motion of the release handle 138 to the inward motion of the latch rods 122, and vice versa.

Although the invention has been described in detail with reference to certain preferred embodiments, variations and modifications exist within the scope and spirit of the invention as described and defined in the following claims.

What is claimed is:

1. A foldable juvenile chair comprising a seat, a back, a collapsible frame assembly movable between an unfolded use position and a folded storage position, means for attaching each of the seat and back to the collapsible frame assembly for movement relative to the collapsible frame assembly during movement of said assembly between its use and storage positions so that the seat and back are aligned relative to one another in a chair-forming position to support an occupant seated therebetween in response to movement of the collapsible frame assembly to its unfolded use position, means for locking the back and collapsible frame assembly together to block movement of the collapsible frame assembly from its unfolded use position toward its folded storage position so that the seat and back are fixed relative to one another in the chair-forming position, and means for releasing the locking means to permit movement of the collapsible frame assembly from its unfolded use position to its folded storage position, the releasing means being connected to the locking means and the back and supported for movement relative to the back, the releasing means including means for automatically establishing a partly folded safety stop position of the collapsible frame assembly intermediate the unfolded use position and the folded storage position during movement of the collapsible frame assembly from its unfolded use position toward its folded storage position to aid in preventing inadvertent movement of the collapsible frame assembly to its folded storage position.

2. A foldable juvenile chair comprising a seat, a back, a collapsible frame assembly movable between an unfolded use position and a folded storage position, means for attaching each of the seat and back to the collapsible frame assembly for movement relative to the collapsible frame assembly during movement of said assembly between its use and storage position so that the seat and back are aligned relative to one another in a chair-forming position to support an occupant seated therebetween in response to movement of the collapsible frame assembly to its unfolded use position, means for locking the back and collapsible frame assembly together to block movement of the collapsible frame assembly from its unfolded use position toward its folded storage position so that the seat and back are fixed relative to one another in the chair-forming position, and means for releasing the locking means to permit movement of the collapsible frame assembly from its unfolded use position to its folded storage position, the releasing means being connected to the locking means and the back and supported for movement relative to the back, the releasing means including a release handle formed to include a recessed finger grip portion receiving the fingers of a user hand operating the release means, the back including means for supporting the palm of the hand operating the release means to position said fingers in engagement with the recessed finger grip portion.

3. The chair of claim 2, wherein the releasing means further includes guiding means connected to the back for guiding the release handle for movement relative to the supporting means between a locking position activating the locking means to lock the collapsible frame assembly in its unfolded use position and an unlocking position releasing the locking means to unlock the collapsible frame assembly so that it is movable to its folded storage position and spring means interconnecting the back and the release handle for yieldably biasing the release handle to its locking position so that the collapsible frame assembly is normally locked to the back when in its unfolded use position.

4. The chair of claim 2, wherein the releasing means further includes guiding means connected to the back for guiding the release handle for movement relative to the supporting means between a locking position activating the locking means to lock the collapsible frame assembly in its unfolded use position and an unlocking position releasing the locking means to unlock the collapsible frame assembly so that it is movable to its folded storage position, the release handle moves relative to the back in a direction away from the supporting means to reach its locking position and in an opposite direction toward the supporting means to reach its unlocking position, and the release handle is moved toward its unlocking position upon movement of the recessed finger grip portion toward the supporting means in response to inward curling movement of the user's hand to make a fist while the palm of the hand is resting on the supporting means of the back and the fingers of the hand are inserted into the recessed finger grip portion of the release handle.

5. The chair of claim 2, wherein the back is formed to include an interior cavity and an aperture providing an opening into the interior cavity, the release handle is disposed in the interior cavity and the recessed finger grip portion is positioned in the aperture and movable therein in response to movement of the release handle in the interior cavity between its locking and unlocking position.

6. The chair of claim 2, wherein the back is hollow and includes a rearwardly facing side wall and an upwardly facing top wall, the top wall is configured to define the supporting means, the side wall is formed to include an aperture in close proximity to the top wall, and the recessed finger grip portion is positioned in the aperture and movable therein in response to movement of the release handle between its locking and unlocking position.

7. A foldable juvenile chair comprising a seat, a back, a collapsible frame assembly movable between an unfolded use position and a folded storage position, means for attaching each of the seat and back to the collapsible frame assembly for movement relative to the collapsible frame assembly during movement of said assembly between its use and storage positions so that the seat and back are aligned relative to one another in a chair-forming position to support an occupant seated therebetween in response to movement of the collapsible frame assembly to its unfolded use position, means for locking the back and collapsible frame assembly together to block movement of the collapsible frame assembly from its unfolded use position toward its folded storage position so that the seat and back are fixed relative to one another in the chair-forming position, and means for releasing the locking means to permit movement of the collapsible frame assembly from its unfolded use position to its folded storage position, the releasing means being connected to the locking means and the back and supported for movement relative to the back, the back being formed to include an interior cavity, a first cavity opening presented toward the collapsible frame assembly, and a second cavity opening, the locking means being disposed in the interior cavity and including a latch rod projecting through the first cavity opening to engage the collapsible frame assembly so that movement of the collapsible frame assembly toward its folded storage position is blocked, and the releasing means being disposed in the interior cavity and including a release handle protruding from the second cavity opening and movable therein and disengaging means interconnecting the release handle and the latch rod for disengaging the latch rod and the collapsible frame assembly in response to movement of the release handle in the second cavity opening to permit movement of the collapsible frame assembly to its folded storage position.

8. The chair of claim 7, wherein the collapsible frame assembly includes an armrest assembly formed to include a latch-receiving aperture opening toward the back, and the latch rod includes a distal end inserted into the latch-receiving aperture in the armrest assembly to block movement of the back relative to the armrest assembly so that the collapsible frame assembly is releasably locked in its unfolded use position.

9. The chair of claim 8, wherein the interconnecting means further includes bracing means connected to the back for bracing the latch rod for reciprocating movement between an extended position inserted into the latch-receiving aperture in the armrest assembly and a retracted position disengaging the armrest assembly in response to movement of the release handle in the second cavity opening.

10. The chair of claim 8, wherein the attaching means includes a pivot pin interconnecting the back and the rear leg to permit pivotable movement of the back relative to the rear leg during movement of the collapsible frame assembly between its unfolded use position and folded storage position, and the latch rod distal end in the latch-receiving aperture acts to block pivoting movement of the armrest assembly and rear leg relative to the back so that inadvertent collapse of the collapsible frame assembly is prevented, and the pivot pin and latch rod are situated in substantially spaced-apart parallel relation.

11. The chair of claim 8, wherein the disengaging means includes a linkage supported in the interior cavity for movement relative to the back, the releasing means further includes means for coupling the release handle to the back for movement in the second cavity opening between a latch-extending position and latch-retracting position, and spring means interconnecting the release handle and the back for yieldably biasing the release handle to its latch-extending position so that the linkage is moved relative to the back to urge the latch rod through the first cavity opening normally to an extended position engaging the collapsible frame assembly, the linkage operating to move the latch rod relative to the back to a retracted position disengaging the collapsible frame assembly in response to movement of the release handle to its latch-retracting position against the biasing force provided by the spring means.

12. The chair of claim 10, wherein the linkage includes a retractor plate connected to the release handle for movement therewith and formed to include a diagonally extending slot and moved therein in response to movement of the release handle to move the latch rod between its extended and retracted positions, and the latch rod includes a hook and disposed in the diagonally extending slot and moved therein in response to movement of the release handle to move the latch rod between its extended and retracted positions.

13. A foldable juvenile chair comprising a seat, a back, a collapsible frame assembly movable between an unfolded use position and a folded storage position, the collapsible frame assembly including an armrest assembly, means for pivotably coupling each of the seat and back to the collapsible frame assembly for movement relative to the collapsible frame assembly during movement of said assembly between its use and storage positions so that the seat and back are aligned relative to one another in a chair-forming position to support an occupant seated therebetween in response to movement of the collapsible frame assembly to its unfolded use position, means for locking the back and collapsible frame assembly together to block movement of the collapsible frame assembly from its unfolded use position toward its folded storage position so that the seat and back are fixed in the chair-forming position, the locking means including a latch rod configured to engage the armrest assembly and bracing means connected to the back for bracing the latch rod for reciprocating movement between an extended position engaging the armrest assembly to block pivoting movement of the back relative to the collapsible frame assembly and a retracted position away form the armrest assembly to permit pivoting movement of the back relative to the collapsible frame assembly to enable movement of the collapsible frame assembly to its folded storage position, and means for releasing the locking means to move the latch rod to its retracted position so that the collapsible frame assembly is movable from its unfolded use position to its folded storage position, the releasing means being connected to the locking means and the back and supported for movement relative to the back, the releasing means including a release handle formed to include a recessed finger grip portion receiving the fingers of a user hand operating the release means, the back including means for supporting the palm of the hand operating the release means to position said fingers in engagement with the recessed finger grip portion.

14. The chair of claim 13, wherein the releasing means further includes guiding means connected to the back for guiding the release handle for movement relative to the supporting means between a locking position urging the latch rod to its extended position to lock the collapsible frame assembly in its unfolded use position and an unlocking position urging the latch rod to its retracted position to unlock the collapsible frame assembly so that it is movable to its folded storage position biasing the release handle to its locking position so that the collapsible frame assembly is normally locked to the back when in its unfolded use position.

15. The chair of claim 13, wherein the releasing means further includes guiding means connected to the back for guiding the release handle for movement relative to the supporting means between a locking position urging the latch rod to its extended position to lock the collapsible frame assembly in its unfolded use position and an unlocking position urging the latch rod to its retracted position to unlock the collapsible frame assembly so that it is movable to its folded storage position, the release handle moves relative to the back in a direction away from the supporting means to reach its locking position and in an opposite direction toward the supporting means to reach its unlocking position, and the release handle is moved toward its unlocking position upon movement of the recessed finger grip portion toward the supporting means in response to inward curling movement of the user's hand to make a fist while the palm of the hand is resting on the supporting means of the back and the fingers of the hand are inserted into the recessed finger grip portion of the release handle.

16. The chair of claim 13, wherein the back is formed to include an interior cavity and an aperture providing an opening into the interior cavity, the release handle is dispose din the interior cavity, and the recessed finger grip portion is positioned in the aperture and movable therein response to movement of the release handle in the interior cavity between its locking and unlocking position.

17. The chair of claim 13, wherein the back is hollow and includes a rearwardly facing side wall and an upwardly facing top wall, the top wall is configured to define the supporting means, the side wall is formed to include an aperture in close proximity to the top wall, and the recessed finger grip portion is positioned in the aperture and movable therein in response to movement of the release handle between its locking and unlocking position.

18. The chair of claim 13, wherein the armrest assembly is formed to include an aperture presented toward the back and the bracing means is configured to guide a distal end of the latch rod into the aperture in the armrest assembly to prevent movement of the collapsible frame assembly to its folded storage position.

19. The chair of claim 13, wherein the back includes a front portion facing toward the seat and a rear portion facing away from the seat, the front and rear portions cooperate to define a hollow interior region within the back, the latch rod and the bracing means are disposed in the hollow interior region, and the latch rod includes a distal end extending through an opening formed in the back to engage the armrest assembly upon movement of the latch rod to its extended position.

20. The chair of claim 19, wherein the front portion includes an inner wall facing toward the back portion, the bracing means includes a guide member appended to the inner wall of the front portion to lie in the hollow interior region of the back, and the guide member is formed to include a latch rod-receiving channel.

21. The chair of claim 19, wherein the rear portion includes an inner wall facing toward the front portion, the bracing means includes a frame member appended to the inner wall of the rear portion to lie in the hollow interior region of the back, the frame member is formed to include a latch rod-receiving aperture having an opening presented toward the armrest assembly, and the latch rod extends through the latch rod-receiving aperture in the frame member in both of its extended and retracted positions.

22. A foldable juvenile chair comprising a seat, a back, a collapsible frame assembly movable between an unfolded use position and a folded storage position, the collapsible frame assembly including an armrest assembly, means for pivotably coupling each of the seat and back to the collapsible frame assembly for movement relative to the collapsible frame assembly during movement of said assembly between its use and storage positions so that the seat and back are aligned relative to one another in a chair-forming position to support an occupant seated therebetween in response to movement of the collapsible frame assembly to its unfolded use position, means for locking the back and collapsible frame assembly together to block movement of the collapsible frame assembly from its unfolded use position toward its folded storage position so that the seat and back are fixed in the chair-forming position, the locking means including a latch rod configured to engage the armrest assembly and bracing means connected to the back for bracing the latch rod for reciprocating movement between an extended position engaging the armrest assembly to block pivoting movement of the back relative to the collapsible frame assembly and a retracted position away from the armrest assembly to permit pivoting movement of the back relative to the collapsible frame assembly to enable movement of the collapsible frame assembly to its folded storage position, and means for releasing the locking means to move the latch rod to its retracted position so that the collapsible frame assembly is movable from its unfolded use position to its folded storage position, the releasing means being connected to the back and supported for movement relative to the back, the releasing means including a release handle, means for coupling the release handle to the back for movement between latch-extending position and a latch-retracting position, and means for moving the latch rod from its extended position to its retracted position in response to movement of the release handle to its latch-retracting position, the moving means interconnecting the latch rod and the release handle.

23. The chair of claim 22, wherein the back includes a front portion facing toward the seat and a rear portion facing away from the seat, the front and rear portions cooperate to define an interior cavity within the back, the rear portion is formed to include a handle-exposing aperture, the release handle and the coupling means are disposed in the interior cavity within the back, and the release handle includes a hand grip portion positioned in the handle-exposing aperture of the rear portion to be reachable by hand during movement of the release handle between its latch-extending and latch-retracting positions.

24. The chair of claim 23, wherein the moving means is disposed in the interior cavity within the back and movable therein to retract the latch rod in response to operation of the release handle, the releasing means further includes means on at least one of the front and rear portion for guiding the moving means in the interior cavity during movement of the moving means therein relative to the back.

25. A foldable juvenile chair comprising a seat, a back, a collapsible leg frame pivotably connected to the seat and back to couple the seat and back for relative movement between an occupant-seating use position and a fully folded storage position, the frame being formed to include a latch-receiving aperture presented toward the back upon movement of the frame to its uncollapsed use position, and controlling means mounted in the back for controlling interlocking of the back and the collapsible frame alternatively to lock the frame with respect to the back in an uncollapsed use position supporting the seat and back in the occupant-seating use position and unlock the frame for movement relative to the back to permit manual collapse of the frame toward a collapsed position supporting the seat and back in the fully folded storage position, the controlling means including a latch rod movable in the back between a latching position projected from the back to enter the latch-receiving aperture in the frame so that the back and the frame are interlocked and a non-latching position withdrawn from the latch-receiving aperture so that the frame is movable relative to the back toward its collapsed position, a release handle mounted for movement relative to the frame between frame-locking and frame-releasing positions, the release handle being mounted to protrude from the frame to lie in a position accessible to an operator intent on collapsing the frame, and withdrawing means interconnecting the latch rod and the release handle for withdrawing the latch rod from its latching position in the latch-receiving aperture in response to manual movement of the release handle relative to the back to its frame-releasing position, the withdrawing means including a retractor assembly coupled to the release handle for movement therewith, the retractor assembly being formed to include a guide slot, and the latch rod including a latch hook received in the guide slot and slidable therein in response to movement of the retractor assembly to control the position of the latch rod relative to the latch-receiving aperture in the frame.

26. The chair of claim 24, wherein the release handle is formed to include a recessed finger grip portion receiving the fingers of a user hand operating the release means, the back includes means for supporting the palm of the hand operating the release means to position said fingers in engagement with the recessed finger grip portion.

27. The chair of claim 26, wherein the controlling means further includes guiding means connected to the back for guiding the release handle for movement relative to the supporting means between its frame-locking and frame-releasing positions and spring means interconnecting the lock and the release handle for yieldably biasing the release handle in a direction away from the supporting means to its frame-locking position so that the collapsible leg frame is normally locked to the back when in its occupant-seating use position.

28. A foldable juvenile chair comprising a seat, a back, a collapsible frame assembly movable between an unfolded use position and a folded storage position, the collapsible frame assembly including an armrest assembly formed to include a bolt-receiving aperture, means for attaching each of the seat and back to the collapsible frame assembly for movement relative to the collapsible frame assembly during movement of said assembly between its use and storage positions so that the seat and back are aligned relative to one another in a chair-forming position to support an occupant seated therebetween in response to movement of the collapsible frame assembly to its unfolded use position, means locking the back and collapsible frame assembly together to block movement of the collapsible frame assembly from its unfolded use position toward its folded storage position so that the seat and back are fixed relative to one another in the chair-forming position, the locking means including an elongated latch rod having a latch hook at one of its ends and a locking bolt at the other of its ends, and means for releasing the locking means to permit movement of the collapsible frame assembly from its unfolded use position to its folded storage position, the releasing means being connected to the locking means and the back and supported for movement relative to the back, the releasing means including a release handle having a hand grip portion, a retractor plate formed to include a slot receiving the latch hook for sliding movement therein between latching and unlatching positions, a connecting rod interconnecting the release handle and the retractor plate to move the retractor plate in response to movement of the release handle, the back including means for bracing the locking means and the releasing means for movement relative to the back so that movement of the release handle relative to the back to one of a first position causes the retractor plate to move the latch hook in one direction in the slot to its latching position, thereby moving the latch rod relative to the back to urge the bolt into the bolt-receiving aperture in the armrest assembly, and a second position causes the retractor plate to move the latch hook in an opposite second direction in the slot to its unlatching position, thereby moving the latch rod relative to the back to withdraw the bolt from engagement in the bolt-receiving aperture in the armrest assembly.

29. The chair of claim 28, wherein the releasing means further includes spring means interconnecting the release handle and the back for yieldably biasing the release handle to its first position normally to block movement of the collapsible frame assembly to its folded storage position.

30. The chair of claim 28, wherein the back is formed to include an interior cavity and a cavity opening presented toward the bolt-receiving opening formed in the armrest assembly, and the latch rod is supported by the bracing means to extend through the cavity opening so that the bolt is inserted into the bolt-receiving aperture upon movement of the release handle to its first position.

31. The chair of claim 28, wherein the back is formed to include an interior cavity and a cavity opening, the release handle is disposed in the interior cavity to cause the handle grip portion to protrude from the cavity opening, and the handle grip portion is movable in the cavity opening to move the release handle between its first and second positions relative to the back.

32. A foldable juvenile chair comprising a seat, a back, a collapsible frame assembly movable between an unfolded use position and a folded storage position, means for attaching each of the seat and back to the collapsible frame assembly for movement relative to the collapsible frame assembly during movement of said assembly between its use and storage positions so that the seat and back are aligned relative to one another in a chair-forming position to support an occupant seated therebetween in response to movement of the collapsible frame assembly to its unfolded use position, the back including means for selectively engaging the collapsible frame assembly to block movement of the back relative to the collapsible frame assembly, the collapsible frame assembly being formed to include first receiving means for receiving the engaging means to lock the collapsible frame assembly in its unfolded use position and second receiving means for receiving the engaging means during movement of the collapsible frame assembly from its unfolded use position toward its folded storage position to lock the collapsible frame assembly in a partly folded safety stop position intermediate the unfolded use position and the folded storage position.

33. The chair of claim 32, wherein the collapsible frame assembly includes a front leg, a rear leg, and an armrest member pivotably connected to the front and rear legs, and the armrest member is formed to include the first and second receiving means.

34. The chair of claim 32, wherein the collapsible frame assembly includes a bracket formed to include an aperture defining the first receiving means and a slot defining the second receiving means.

35. The chair of claim 34, wherein the link member includes a bottom wall and a side wall cooperating to define the slot, the bottom wall is formed to include an engaging means-receiving opening communicating with the aperture, and the side wall includes an end wall abutting the engaging means to establish the partly folded safety stop position.

* * * * *